United States Patent [19]

Rosenthal

[11] Patent Number: 4,541,727

[45] **Date of Patent: * Sep. 17, 1985**

[54] LENTICULAR OPTICAL SYSTEM

[76] Inventor: Bruce A. Rosenthal, 6 Bulaire Rd., East Rockaway, N.Y. 11518

[ * ] Notice: The portion of the term of this patent subsequent to Jul. 12, 1994 has been disclaimed.

[21] Appl. No.: 591,709

[22] Filed: Mar. 21, 1984

Related U.S. Application Data

[63] Continuation of Ser. No. 451,667, Dec. 21, 1982, abandoned, which is a continuation of Ser. No. 345,850, Feb. 4, 1982, abandoned, which is a continuation of Ser. No. 52,136, Jun. 26, 1979, abandoned, which is a continuation of Ser. No. 775,715, Mar. 9, 1977, abandoned, which is a continuation of Ser. No. 641,257, Dec. 16, 1975, Pat. No. 4,034,555.

[51] Int. Cl.[4] ..... G04B 19/06

[52] U.S. Cl. ..... 368/232; 350/167

[58] Field of Search ..... 350/167, 173, 131; 40/437; 272/8 R, 8 D; 368/232

[56] References Cited

U.S. PATENT DOCUMENTS 4,034,555 7/1977 Rosenthal ..... 350/167

*Primary Examiner*—Bruce Y. Arnold

*Attorney, Agent, or Firm*—Paul J. Sutton

[57] ABSTRACT

The present invention includes an optical system with a first composite image viewable through a lenticular lens sheet. The first composite image is formed of a multiplicity of spaced apart parallel stripes with transparent stripes or voids therebetween. A second composite image or indicia can be positioned beneath the first composite image in a second plane. When viewed along one angle, the first composite image is visible. When viewed along a second angle, the second composite image is viewed through the transparent stripes or voids in the first composite image. A watch utilizing this optical system is also described.

1 Claim, 9 Drawing Figures

FIG. 5B
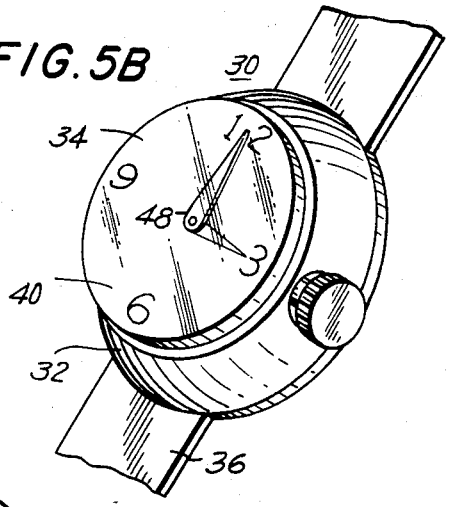
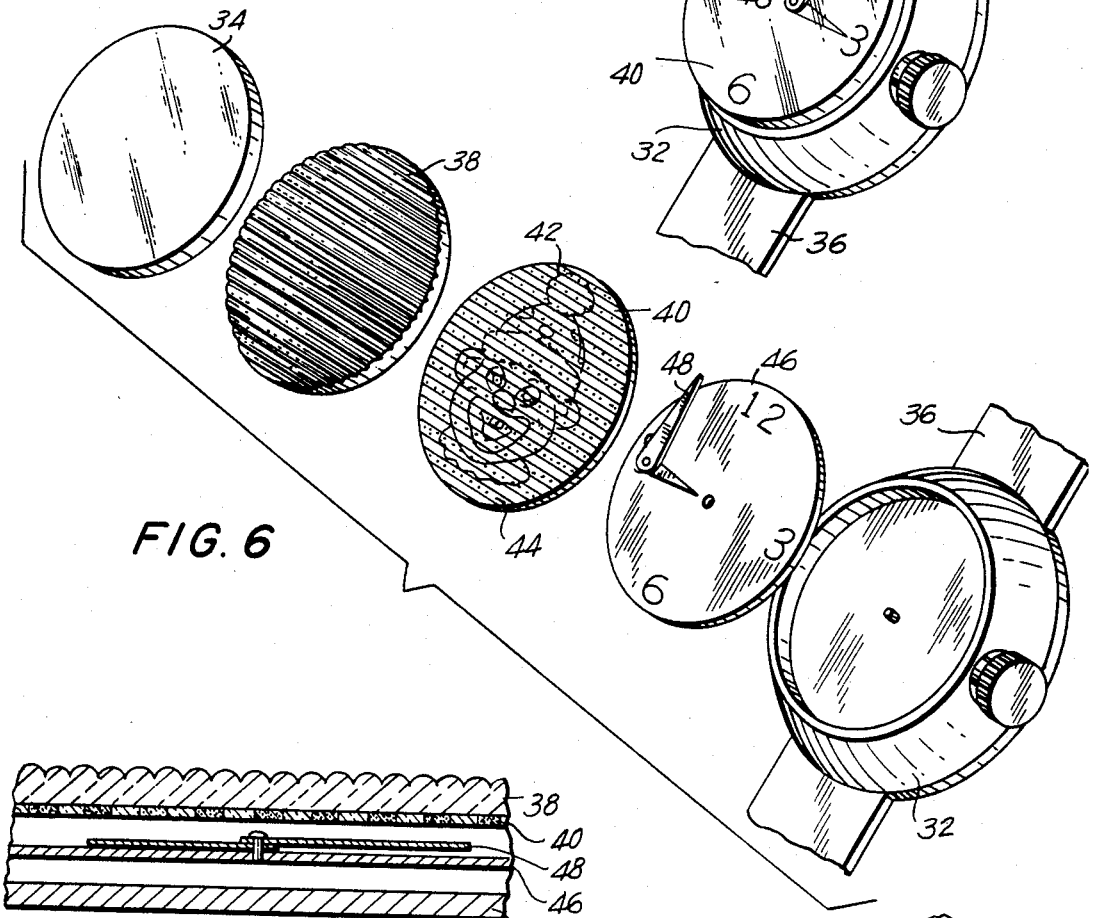
FIG. 6
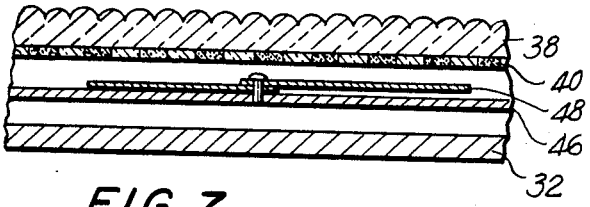
FIG. 7
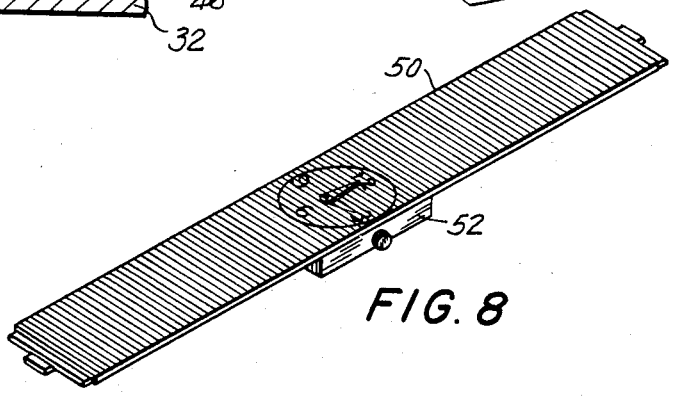
FIG. 8

LENTICULAR OPTICAL SYSTEM

This application is a continuation of 06/451,667 filed 12/21/82, abandoned; which is a continuation of 06/345,850 filed 02/04/82, abandoned; which is a continuation of 06/052,136 filed 06/26/79, abandoned; which is a continuation of 05/775,715 filed 03/09/77, abandoned; which is a continuation of 05/641,257 filed 12/16/75, now U.S. Pat. No. 4,034,555.

This invention relates generally to an optical system and more particularly to a lenticular optical system through which various composite images can be viewed.

Lenticular lenses are well known for use in optical systems to produce various types of unique optical effects. The known lenticular lens systems generally include a transparent sheet having a plane surface on one side thereof and on the other side, a series of parallel longitudinal ridges which have near-parabolic or circular smooth surfaces creating a multi-lenticular system of convex lenses. A print sheet or medium is generally disposed at the back of the lens adjacent to or on the plain surface. The print sheet contains at least two alternate series of spaced image lines, each series of image lines constituting a dissection or breakup of a master picture. The two series of image lines are so optically related with respect to the lens elements as to be alternately visible upon positional change of the viewer with respect to the lenses. When viewed from one position, the first series of image lines are visible so as to display the first composite picture. When viewed from a second position, the second series of lines are visable so as to display the second composite picture.

The same lenticular lens system can also be utilized to produce a three-dimensional picture effect. In forming such effects, the two images respectively constitute a right eye view of an object and a left eye view of the same object in normal visual parallax. The lenticular lenses are placed to lie along a line perpendicular to an imaginary linedrawn through the two pupils of the eyes of the viewer. In this manner, the convex lenses provide the desired optical effect to divert light rays from the image lines making up the right eye elements of the picture into the right eye of the viewer and, in the same way, the left eye elements of the picture into left eye of the viewer, thereby creating the illusion of three-dimensional vision in the viewer's mind.

Lenticular optical systems have found numerous uses including toys, pins, and other types of "gag" devices. However, they have also found more serious uses such as for teachings devices, wherein questions appear in one view and the answers to these questions appear in the other view; medical devices for viewing changes in x-rays, specimens, etc., photography, printing and visual aid systems.

Specifically, U.S. Pat. No. 3,586,592 shows the use of a lenticular lens system to produce a three-dimensional picture and specifically utilizes alternate striations placed on a curved reflecting mirror. The use of lenticular lenses for permitting the viewing of two different pictures is described by way of example in U.S. Pat. Nos. 3,225,457 and 2,832,593. The first of these patents discusses the use of lenticular devices for teaching aids and the second describes its use as an ocular toy. In both patents, the two composite images are located on a single sheet beneath the lenticular lenses. U.S. Pat. No. 3,832,032 describes a lenticular lens system for a rear projection screen wherein the plane surface of the lens is provided with a plurality of light diffusing stripes alternating with light absorbing stripes to avoid deterioration of the contrast of an image projected through the screen. Various prior art patents describe multilayer lenticular light systems such as U.S. Pat. No. 3,213,753 which uses such multilayers for a light polarizing device. On the other hand, U.S. Pat. No. 3,706,486 uses a plurality of layers of lenses for phtotgraphy purposes. One of the layers includes diaphragm apertures of various sizes for improved focusing purposes. U.S. Pat. No. 3,827,783 forms the lenticular lenses between surfaces of plane surfaced sheets to reflect or focus light directed through the sheets.

In U.S. Pat. No. 3,827,798, an optical device is described which uses optical elements of reduced thickness to form the discrete lens faces. U.S. Pat. No. 3,781,091 also uses an optical device having different thicknesses to permit modulation of an optical image.

Lenticular lenses find various uses such as a ceiling mounted luminaire for transmitting light enclosed therein as is described in U.S. Pat. No. 3,721,818. Also, it can be used as a viewing plate for a television screen as is described in U.S. Pat. No. 2,740,954 where the lens system optically resolves the televison lines into a series of dots. Such lenses have also found use as a contact lens where two such lenticular lenses are placed adjacent each other as described in U.S. Pat. No. 3,526,451. Such lenses have been put together in various shapes to permit light transmitted through one part of the shape to pass through a different portion of the shaped lens and thereby provide optical variations as a function of the angle of the incidence of the striking light. To improve the efficiency of such lenses, U.S. Pat. No. 3,565,733 teaches the spacing apart of the lenticles of a screen thereby reducing the amount of absorption of light within the screen. U.S. Pat. No. 3,449,158 describes a particular method of making a phased lenticular composite which can produce the effects of lenticular lenses.

One major drawback of existing lenticular lens systems is the permanence of the pictures being viewed. Since both viewed pictures or images are alternately spaced in adjacent relationship to each other on the same print sheet, the lens system is limited to viewing the two pictures which have been placed on the print sheet. In order to change one of the pictures, it is necessary to change or reprint the other picture as well. This severely restricts the applications of lenticular lens systems since the same two pictures will always be viewed and the same two sets of information will always be compared. It is generally not available to retain one of the pictures while independently replacing the other picture.

Such independent replacement of one composite picture with respect to the other would find great use in numerous types of applications. For example, it would be possible to maintain one picture fixed while constantly varying the other to thereby provide a comparison of variables against a fixed standard. In comparing x-rays, it would be possible to have one fixed x-ray representing a normal situation and to have a series of x-rays independently interchangeable so as to compare the series of x-rays with the fixed normal x-ray. In another capacity, it would be possible to have the fixed picture be a darkened portion to produce a completely black image. The other pictures could then be varied to provide a series of viewable scenes which can be interchanged. By changing the viewing angle, the viewer would see the black image between each of the interchanging views in a manner similar to that of a repetitive slide projector. Additional use could be found in toys or jewelry where one image is kept fixed and the other image changed to provide a series of different toys or jewelry. For example, a watch could be formed having the watch face as the fixed composite image and having the second composite image variable to thereby form a complete series of different style watches, each providing a different picture when viewed in one of its two directions.

It is an object of the present invention to provide a lenticular optical system which permits independent replaceability of each of two composite images viewed through lenticular lenses.

Another object of the present invention is to provide a lenticular optical system which includes a first composite image which can be viewed through lenticular lenses and wherein the first composite image is formed of a multiplicity of spaced apart parallel strips with transparent stripes therebetween.

Yet another object of the present invention is to provide a lenticular lens system having a first composite image lie in a first plane and a second composite image lie in a second plane beneath the first plane and wherein both planes are viewable through the lenticular lenses and wherein said second plane contains information created by frontal, rearward or inherent projection.

Still a further object of the present invention is to provide a lenticular optical system through which at least two composite pictures can be viewed and wherein an object will only be viewed in conjunction with one of the composite pictures.

Yet a further object of the present invention is to provide a lenticular optical system in combination with a watch to permit the viewing of two pictures by changing the viewing angle.

Still another object of the present invention is to provide a watch having a lenticular lens system viewable through the watch crystal such that a first composite picture can be viewed along one viewing direction displaying a watch face and a second composite picture can be viewed along another viewing direction displaying a picture or other information.

Still another object of the present invention is to provide a watch having a lenticular optical system whereby a first composite picture representing a watchface is viewable along one angle and a second composite picture is viewable along another angle and wherein the watch hands are only viewable when viewing the watchface.

Another object of the invention is to fulfill all of the aforementioned objects and overcome the limitations and disadvantages of prior lenticular optical systems.

According to one aspect of the concept of the present invention, the novel means or steps which are employed to overcome the disadvantages of the prior art include an optical system comprising a transparent sheet having a plane surface at one side of the sheet and its opposite surface constituted by a multiplicity of parallel lenticular lenses. A first composite image is positioned with respect to the plane surface of the transparent sheet. The first composite image is formed of a multiplicity of spaced apart parallel strips with transparent strips therebetween. A second composite image can be positioned beneath the first composite image and can also be formed of a multiplicity of spaced apart parallel strips wherein the strips of the second composite image are positioned beneath the transparent strips of the first composite image.

My invention will be more clearly understood from the following description of specific embodiments of the invention, together with the accompanying drawings, wherein similar reference characters denote similar elements throughout the several views and in which:

FIGS. 5A and 5B show isometric views of a watch employing the optical system of the present invention and specifically showing the two composite images viewable;

FIG. 6 is an exploded isometric view of the basic elements forming the watch in accordance with an embodiment of the present invention;

FIG. 7 is a sectional elevational view of the watch employing the optical system of the present invention wherein the lens itself serves as the watchface; and FIG. 8 is a variation on the watch shown, wherein the complete band is formed of a lenticular lens material.

Before describing this invention in detail with respect to the drawings annexed hereto, it should be noted that following the description of the drawings and the components of the invention disclosed therein, various structural features of my invention will be amplified and expounded upon both with respect to the drawings and with respect to their characteristic features.

Figure 1:
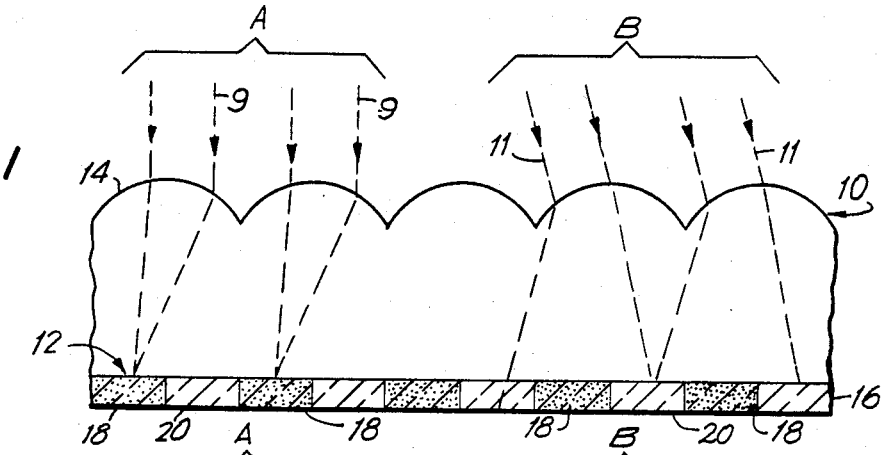
FIG. 1 is a diagrammatic view showing the optical principles on which the prior art devices operate.

Referring now to FIG. 1, there is shown a diagrammatic view of the heretofore known prior art device. This type of device includes a lenticular screen 10 having a plane surface 12 on one side thereof and on the other side a continuous series of ridges 14 forming the lens patterns. Beneath the lenticular screen is a sheet 16 which contains two alternate series of spaced image lines 18, 20. The image lines 18 constitute a dissection of a first master picture while the image lines 20 constitute the dissection of a second master picture. The two series of image lines are optically arranged so as to be alternately visible upon positional change of the viewer with respect to the screen.

By utilizing the arrangement shown in FIG. 1, from the viewing position the lines of site 9 are directed to the lenticular screen at an angle such that they are refracted towards the image lines 18 so that in effect a coherent and comprehensive image of the first master picture will be viewed by the viewer's eye.

If the viewing position were moved to position B, then the lines of sight 11 would strike the curved faces 14 at such an angle that only the picture elements 20 are visible and a composite and comprehensive picture of the second master picture would be viewable by the viewer's eye.

As it is noted, in the prior art device the both picture elements are alternately placed in series of spaced image lines along a single sheet 16 lying in a single plane beneath the lens system. As a result, if one would want to change one of the composite pictures 18, it would be necessary to replace the entire sheet 16 which would also necessitate replacing the picture elements 20.

Figure 2:
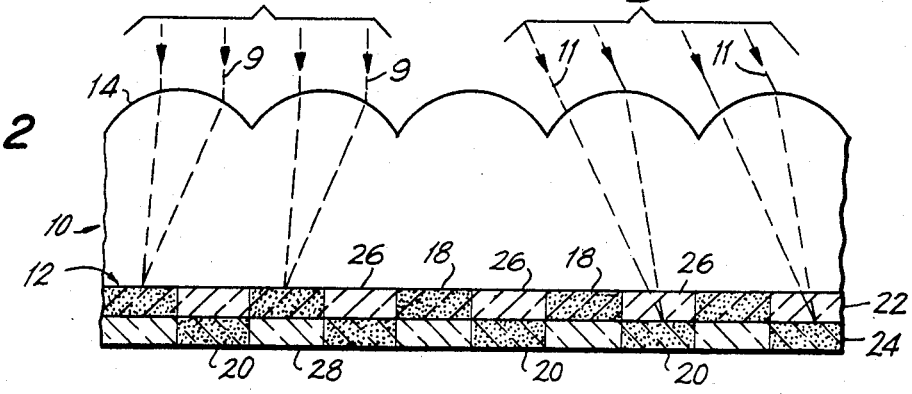
FIG. 2 is a diagrammatic view showing the optical principles upon which one embodiment of the present invention operates.

In FIG. 2 of the drawings, the optical principles of the invention which obtains the improved results is demonstrated. Again, the pictures are viewed through a lenticular lens 10. However, placed adjacent the plane surface 12 of the lenticular lens is a first image sheet 22 which only includes the first composite image. This image is formed of a multiplicity of spaced apart parallel strips constituting a dissection of the first picture image. Alternating with these strips of the first composite image are the transparent strips 26. Placed beneath the first sheet is a second image sheet 24 which contains the second composite image to be viewed. In the embodiment shown in FIG. 2, the second composite image is also formed of a multiplicity of spaced apart parallel strips 20 wherein the parallel strips 20 are positioned beneath the transparent strips 26. The spaces 28 between the second parallel strips 20 can also be transparent.

In FIG. 2, when viewing the system from position A, the lines of sight 9 will reach the lenses at an angle to be deflected whereby the picture elements 18 are viewable to form a composite and comprehensive picture of the first image. When viewed from position B, the lines of the sight 11 will reach the lens at an angle whereby they will be deflected towards the transparent strips 26 through which the viewer will then be able to see the second series of parallel strips 20 positioned beneath the transparent strips 26. The picture elements 20 will form a composite and comprehensive picture of the second composite image in the viewer's eye.

It is understood that viewing positions A and B are shown separated only for clarity of explanation. However, a viewer at position A could merely change the viewing angle and not the position and still be able to view both composite pictures.

Figure 3:
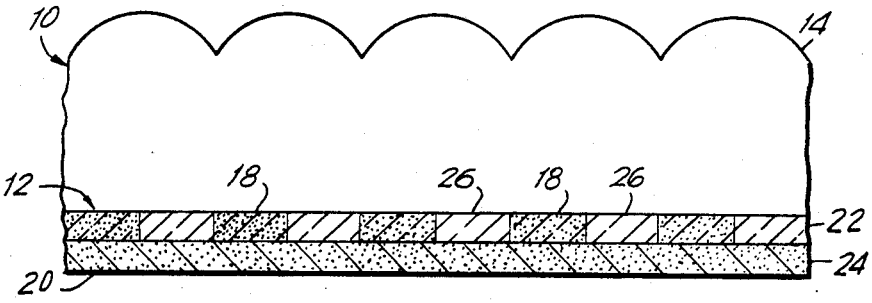
FIG. 3 is a diagrammatic view showing a second embodiment of the present invention.

Referring to FIG. 3, it will be noted that the second image sheet 24 which contains the second composite image need not be formed into a multiplicity of spaced apart parallel strips as a dissection of the composite picture, but rather may include a continuum of the second composite image. An apparent image of the entire composite picture will be viewable through the transparent strips 26 located in the first image sheet 22.

The image sheets can be actual screens containing the respective composite images placed upon them by printing or lamination or other means. Additionally, it is possible to form the first composite image by printing or laminating the multiplicity of spaced apart parallel strips directly on the plane surface 12 of the lenticular lenses.

Figure 4:
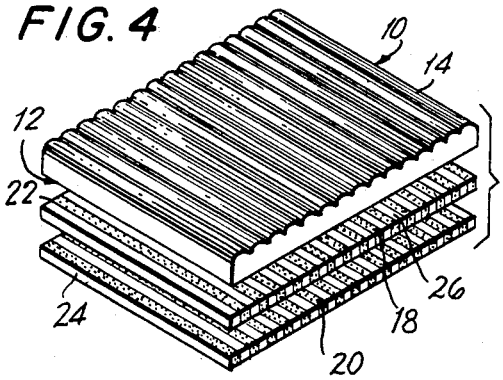
FIG. 4 is an exploded view showing the various elements constituting the basic lenticular optical system of the present invention.

FIG. 4 shows the basic elements of the optical system of the present invention including the lenticular lens screen 10, the first image sheet 22 and the second image sheet 24. It is noted that the second image sheet is located in a plane which is different from and beneath the plane of the first image sheet 22. In this manner it is possible to individually replace either of the composite images without effecting the other. Thus, by way of example, it is possible to have the first image sheet 22 contain the information of a set of standard curves and it is possible to replace the second image sheet 24 with various measured curves. The viewer will then be able to easily compare the standard curves with the series of measured curves by merely changing his position from one angle to another angle while looking through the lenticular lenses. Similarly, x-rays can be compared by utilizing a standard x-ray for the first sheet 22 and having it compared with a series of other x-rays to determine changes or modifications which have occurred in the various x-rays.

It is also possible to independently change the first composite sheet 22 while retaining the sheet 24 in fixed position. For example, if the sheet 22 provides a particular series of words or presents a question in a teaching device, it is possible to replace the question by changing the sheet 22 while retaining the sheet 24 in place. It is also noted that since the image sheets 22 and 24 are in different planes, it is possible to position these two planes in spaced apart relationship so that a particular three-dimensional object can be inserted between the sheets 22 and 24. In this manner, when the first composite picture formed on sheet 22 is viewed, the object placed beneath this sheet will not be visible. However, when the viewer changes his line of sight to be able to see through the transparent strips in the first sheet and onto the second composite image, he will also be able to see the abjects contained below the first image sheet and the viewer will see these objects as placed on top of the second composite image.

Although the discussion heretofore has referred to the information contained on the image sheets as "composite images", it is understood that these terms include all types of information and indicia and need not actually contain a picture image. For example, it is possible that the first composite image merely contains a series of parallel strips of the same color and all being identical to each other, so that if all the strips are merely solid black strips, the first composite image will in fact appear as a sheet of solid black. Similarly, the second composite image can also include identical lines of a single color or single pattern. Additionally, the parallel strips forming the dissection of the picture images need not be solid lines but could be a series of small dots such as a half-tone photo-engraving or may actually include a plurality of very fine parallel lines where the sheet is a simple photoengraving or impression.

The lenticular lenses can include either a large or a small number of ridges per inch. For example, a series of large lenticular lenses might include 16 lenses per inch while very fine lenses might have as many as 117 lenses per inch. An average lenticular lens system would include about 61 lenses per inch. It is generally found that good results are obtained when a pair of alternate strips are positioned beneath a single lens. Thus, by way of example, in FIG. 2 it is noted that the strip 18 in conjunction with the adjacent transparent strip 26 are both positioned beneath a single lenticular lens. In this manner, utilizing a viewing screen 10 with 61 lens elements per inch, and with two composite pictures, the sheet would have 122 parallel lines including 61 of the elements 18 and 61 adjacent transparent strips 26. It is also understood that while only two composite images have been discussed, it is possible to include more than two composite images wherein each of the images would be placed on a different image sheet and positioned in planes one beneath the other. Each of the sheets positioned above a given sheet would contain sufficient transparent strips to accommodate each of the sheets below. Thus, by way of example, if four composite images were to be viewed, the first and uppermost sheet would contain the multiplicity of spaced apart parallel strips forming the first composite image and adjacent thereto contain three transparent strips for viewing the three composite images on each of the three image sheets positioned therebeneath. The three transparent strips can of course be a single strip whose width is sufficient to view the three images therebeneath.

The work "image" is used herein and in the claims hereinbelow is defined to mean a picture, design, writing, indicia or information, printed by a printing press or made by an artist, or writer, or made by a photographic process or by any other means. The reference herein to "transparent strips" expressly contemplates provision of voids as well as a transparent medium.

Figure 5A:
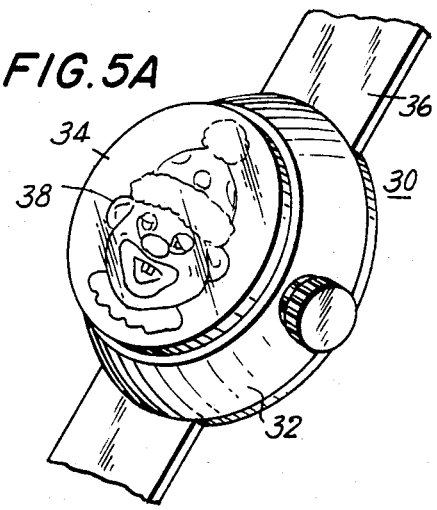

Although the lenticular lens system of the present invention has numerous applications, by way of example, one particular application will be described which results in unique benefits not heretofore obtainable using the prior art system. Referring now to FIG. 5, there will be seen a watch shown generally at 30 which includes a case 32 and a watch cover 34, such as the crystal. The case and the crystal comprise a complete housing which contains all of the elements of a standard watch. A strap 36 can be attached to the housing so that the wearer can place it on his hand. The watch contains the lenticular optical system of the present invention whereby, when the watch is viewed through the crystal 34 in a first position, a picture 38 is seen through the crystal as shown in FIG. 5A. On the other hand, when viewed from a slightly different angle, the watch face 40 is seen, as shown in FIG. 5B. It is to be noted that the dial hands 42 are only visible when the watch face is seen. The dials do not appear superimposed upon the picture 38 shown in FIG. 5A. This benefit has not heretofore been generally achieved. In most prior art watches utilizing lenticular lens systems, although it was possible to alternately view a picture and a watch face, the dials would appear superimposed upon both the picture as well as the watch face. The reason for this was that the watch face and the picture were formed of parallel strips and both placed on a single sheet. It was therefore necessary to place the dials or numbers directly above the single sheet and the dials would always be visible regardless of whether one viewed the picture or the watch face. In the present invention, it is possible to place the dials only above one of the images, specifically above the watch face whereby the picture can be viewed without having the dials visible at all.

FIG. 6 shows in more detail the composite formation of the watch. The watch includes the case 32 which would contain all of the regular watch movements to permit the watch to properly function. The watch cover 34 is so arranged as to be placed over the case 32 and form a composite housing therewith. Placed beneath the cover 34 would be the lenticular lens 38. Beneath the lens, adjacent the plane surface thereof would be the first sheet 40 containing the multiplicity of spaced apart parallel strips 42 forming the first composite image and containing transparent strips 44 alternately spaced therewith. In a plane beneath the first sheet 40 is a second image sheet 46 containing the watch face image. The face image can either be formed in a series of parallel spaced apart strips or can be a complete total image. The dial 48 is positioned between the first and second sheets 40 and 46 whereby it will only be visible as superimposed over the watch face 46 but will not be visible when the picture on the sheet is viewed. The dial 48 is mechanically inter-connected to the watch movement in a well known fashion.

In addition to providing the benefit of having the dials visible in only one of the two positions, another benefit is that the pictures can be changed independently of the watch face. In order to form a series of different watches, all that is needed is to replace the single sheet 40 containing the first composite image while retaining the dials and the watch face.

Referring now to FIG. 7, it is noted that the lenticular lens itself is utilized as the watch crystal. Also, the lines of the first composite picture are formed directly on the underside of the lens. It would also be possible to have a sequence of pictures by using more image sheets positioned each beneath the other previous ones.

FIG. 8 shows a variation of the watch wherein the entire wrist band 50 is formed of a lenticular lens material, such as plastic. The watch 52 is positioned beneath the band with a watch face thereon, as is shown in phantom. The watch band will then provide a uniform surface throughout its length until the viewing angle is changed and the watch is seen through the band. The watch band itself can also include changing patterns by having two or more designs formed thereunder.

The pictures on the watches can be cartoon characters, graphics, pictures, or even a photo of the viewer himself. Also, it can be used as an advertising item by placing a company mark on the picture or on the watch face.

The lenticular screen heretofore described is generally made of transparent material such as cellulose, acetate, glass, transparent plastic, or the like. Also, watches known as "LED" watches may utilize this invention. This invention contemplates its use on clothing utilizing flexible lenticular lenses in which the skin or undergarments of the wearer are alternatively seen with a predetermined pattern of pre-selected colors, shoes, belts, raincoats, shower curtains, screens, wallets, as examples only.

The embodiments of the invention particularly disclosed and described herein are presented merely as examples of the invention. Other embodiments, forms and modifications of the invention coming within the proper scope and spirit of the appended claims will, of course, readily suggest themselves to those skilled in the art.

What is claimed is:

1. An optical system for use in viewing at least a first and a second image, each of which are alternately perceived by the user of this system as relatively independent of one another, comprising, in combination:

a transparent sheet of plastic material having first and second oppositely facing surfaces, one of said surfaces being constituted by a plurality of substantially parallel lenticular-type lenses, a first image viewable by the user of the optical system, said first image formed at least in part of a plurality of spaced apart substantially parallel strips of indicia, spaces between said substantially parallel strips of indicia being characterized by the absence of such indicia and being further characterized by the ability to transmit light therethrough, at least one object disposed such that said transparent sheet is positioned between said object and the user of the optical system, said object being at least in part viewable by said user through portions of said sheet including said spaces between said strips of indicia, said first image being supported by one of said surfaces of said transparent sheet of material, the presence of said object contributing to a second image viewable alternately with said first image by the user of said optical system through said sheet of transparent material, said object being spaced a predetermined distance from said second surface of said transparent sheet of material, said lenticular-type lenses being disposed at said first surface, said first and second images together at least in part to the viewer of said optical system being perceived as forming a third composite image of the combination thereof, said strips of indicia having dimensions including widths of substantially equal first magnitudes, said lenticular-type lenses having dimensions including widths of substantially equal second magnitudes, said first magnitudes being substantially equal to one another, said second magnitudes being substantially equal to one another, said first image comprising indicia printed upon one of said first or second surfaces of said sheet of transparent sheet material, the said optical system being capable of affording the user thereof an ability to select and replace said object to provide a system capable of exhibiting a variety of predetermined composite images.

* * * * *